US005752561A

United States Patent [19]

Dorofeev et al.

[11] Patent Number: 5,752,561

[45] Date of Patent: May 19, 1998

[54] METHOD FOR PRODUCINGAN INTERMEDIATE PRODUCT FOR METALLURGICAL PROCESSING

[75] Inventors: Genrikh Alekseevich Dorofeev; Aleksandr Vladimirovich Makurov; Anatolii Georgievich Sitnov; Aleksandr Nikolaevich Panfilov; Eduard Emmanuilovich Minikes; Nikolai Ivanovich Yurin; Arkadii Nikolaevich Ponomarev; Yevgenii Nektar'Veich Ivashina; Gennadii Pavlovich Zuev, all of Tula, Russian Federation

[73] Assignee: Intermet-Service & Co., Tula, Russian Federation

[21] Appl. No.: 567,546

[22] Filed: Dec. 5, 1995

[51] Int. Cl.[6] ..... B22D 27/00

[52] U.S. Cl. ..... 164/57.1; 164/97

[58] Field of Search ..... 164/79, 55.1, 58.1, 164/57.1, 97, 98

[56] References Cited

U.S. PATENT DOCUMENTS 5,259,442 11/1993 Clark ..... 164/57.1

FOREIGN PATENT DOCUMENTS 58-25858 2/1983 Japan ..... 164/79

*Primary Examiner*—Joseph J. Hail, III
*Assistant Examiner*—I. H. Lin
*Attorney, Agent, or Firm*—Heller Ehrman White & McAuliffe

[57] ABSTRACT

In the production of a metal charge for steelmaking in arc furnaces, a method for producing a low density intermediate charging stock by prefilling the ingot molds of a casting machine with a substance that releases gas at a temperature below the temperature of the charged pig iron, such as limestone, dolomite or caprolactam.

12 Claims, No Drawings

METHOD FOR PRODUCINGAN INTERMEDIATE PRODUCT FOR METALLURGICAL PROCESSING

FIELD OF THE INVENTION

This invention relates generally to ferrous metallurgy and specifically to the production of a metal charge for steelmaking in arc furnaces.

BACKGROUND ART

In steelmaking the production of intermediate products for metallurgical processing in the form of charging stock is well known. A typical prior art process includes precharging of iron-ore pellets (solid filler) into the ingot molds of a casting machine followed by the charging of liquid iron into those same ingot molds. The resulting intermediate product is a standard pig comprised of pig iron with pellets distributed throughout its volume.

A deficiency of prior art methods for producing intermediate products is the extremely limited ability to adjust density. As a result material is produced with a density in the range of 4.5–5.8 gm/cubic centimeter, which approaches the density of heavy scrap. Intermediate products of this density may cause the formation of a dense layer of metal charge in the electric furnace during charging. Such layers have low meltdown rates and limit the possibility of using powerful long arcs with desirable oxygen consumption properties. Furthermore, the risk that metal may be ejected and that electrodes may break increases. In addition the time to clear metal charge from the zone in front of the working door of the electric furnace increases.

It is thus necessary to limit the fraction of intermediate product in the charge to 25–35% and to use less-dense types of metal charge.

Another shortcoming of prior art methods is the narrow range of adjustment of the ratio of pig iron to solid addition agents in the intermediate product, which limits the possible fraction by weight of pellets in the composition of the material to 25%. In many cases this limited amount of pellets is inadequate and it is thus necessary to supplement the process with other components as the heat is under way.

SUMMARY OF THE INVENTION

Objects of the Invention

The primary object of this invention is to produce a pig with reduced density, i.e., with a lower fraction of pig iron in the same volume of pig.

Additional objects, advantages and novel features of the invention will in part be set forth in the description which follows, and in part will become apparent to those skilled in the art upon examination of the disclosure or in the practice of the invention. The invention is capable of other and different embodiments without departing from the scope of the invention. Accordingly, the description is to be regarded as illustrative in nature and not as restrictive.

Disclosure of Invention

The stated objects and other objects and advantages are attained by the incorporation within the precharge of a substance that releases gas at a temperature below the temperature of the charged liquid iron. This substance is first introduced into the working volume of the ingot mold in a quantity of 6–12% by weight, and the ingot mold is filled with melt in the range of 26–60% of its working volume. The gas forming agent is available from a variety of sources, including, but not limited to, limestone, dolomite, other carbonates, and organic addition agents.

DESCRIPTION OF A PREFERRED EMBODIMENT

The method of this invention is practiced by first charging into the bottom of an ingot mold, one or several gas forming components, and then charging solid addition agents, such as pellets into the ingot mold.

When the liquid melt is added to the ingot mold, the gas-forming materials initially placed in the mold release gases. The viscosity of the layer of liquid melt gradually increases because of continuous cooling due to heat exchange with the walls of the ingot mold and the solid addition agents. The gases formed as they pass through the liquid layer of increasing viscosity, cause a swelling of the melt and a rise of the surface area. As a result a material is produced whose composition includes a dispersed gas phase with a density significantly lower than the density of the original monolithic material and which is determined by the relative fraction of gas in the bulk of the pig. Since the liquid metal is kept for a longer time in the central zone of the ingot mold, which is farthest from the cooling effect of the walls of the ingot mold, the highest rise in the level of the melt and the largest growth of the pig are observed precisely in the central area. The height of the pig obtained may exceed the depth of the foundry mold, which makes it possible to produce an intermediate product of different sizes and density with constant depth of the ingot mold.

The range of the amount of gas-forming substance is 6.0–12.0% by weight of the charged pig iron, and is determined by the physical and chemical peculiarities and composition of this substance. The lower limit applies to substances that have a low decomposition temperature, such as $Na_2CO_3$. As the gases filter through the melt at high temperature, the gas volume increases substantially as a result of heating. This makes it possible to achieve the required decrease in density with minimal consumption of the component. The upper limit applies to substances whose decomposition temperature approaches the temperature of the metal being charged, e.g., $CaCO_3$ (900 degreesC.). In this case decomposition proceeds slowly, the amount of gas formed is small, and the degree of gas heating also is relatively low. This requires an increase in the consumption of the component.

The 26–60% degree of filling of the ingot mold with liquid metal was chosen on the basis of the following considerations. Below 26%, the incoming metal cools quickly, and because of loss of liquidity is unable, under the influence of the evolving gases, to rise in the ingot mold and form a pig with reduced density. But when the degree of filling of the ingot mold exceeds 60%, the level of the metal in the ingot mold is too high, and gas formation at the initial time may lead to overflow of the metal across the edge of the ingot mold. This is undesirable, since it increases metal losses.

Example. Calcium Carbonate in a quantity of 0.9 kg was charged into ingot molds secured to the conveyer belt of a casting machine. Then pellets 10–18 mm were charged in a quantity of approximately 2.5kg. Liquid iron was then poured onto the pellets. As a result of the decomposition of calcium carbonate, carbon dioxide was formed. The carbon dioxide while passing through the layer of liquid iron both cooled the pig and by creating pores, reduced the density of the pig.

The test results are presented in the following table.

| Experiment No. | Amt. of gas-forming substance, wt. % of pig iron | Percentage fill of ingot mold with pig iron, % | Gas-forming substance | Density of intermediate product, g/em$^3$ |
|---|---|---|---|---|
| 1 after the prior art | — | 26–50 | — | 5.50–5.80 |
| 2 | 6 | 26 | $CaCO_3$ | 4.24 |
| | | 60 | | 4.82 |
| 3 | 8 | 26.0 | $CaCO_3$ | 3.75 |
| | | 60.0 | | 4.60 |
| 4 | 12 | 26.0 | $CaCO_3$ | 3.65 |
| | | 60.0 | | 3.86 |

The density of the intermediate product is reduced by 20–30% compared with pigs cast on casting machines. In steelmaking using arc furnaces, this reduces current overshoots in the melting period of the metal charge.

Thus it is apparent that the objectives of this invention are achieved. There is a clear and controllable reduction of density. The practice of this invention permits the use of greater percentages of pellets in the intermediate product, which gives mill operators a greater degree of control over both the process and the final product. It is possible to keep the arc long, lower the current, obtain quicker meltdown, lower oxygen consumption, and reduce consumption of electrodes.

We claim:

1. A method of preparing a solid reduced-density intermediate product for metallurgical processing in an ingot mold having a mold depth and a mold volume, the product comprising iron and a solid filler, the method comprising the steps of:

(a) adding a gas-forming substance to the ingot mold;

(b) adding the solid filler to the ingot mold;

(c) adding liquid iron to the ingot mold; and (d) allowing the gas-forming substance to release gases and the liquid iron to solidify, thereby forming the reduced-density intermediate product.

2. The method of claim 1 where the weight of the gas-forming substance is between 6% and 12% of the total weight of the solid filler and the liquid iron.

3. The method of claim 2 where the gas-forming substance comprises a metal carbonate.

4. The method of claim 3 where the gas-forming substance comprises calcium carbonate.

5. The method of claim 2 where the gas-forming substance comprises an organic compound.

6. The method of claim 5 where the gas-forming substance comprises caprolactam.

7. The method of claim 1 where the solid filler comprises iron ore pellets.

8. The method of claim 1 where the volume of liquid iron added to the ingot mold is between 26% and 60% of the mold volume.

9. The method of claim 1 where the intermediate product formed by the process has a height and the height of the intermediate product is varied by varying the weight of the gas-forming substance.

10. The method of claim 9 where the height of the intermediate product is greater than the mold depth.

11. A method of preparing a solid reduced-density intermediate product for metallurgical processing in an ingot mold having a mold volume, the product comprising iron and iron ore pellets, the method comprising the steps of:

(a) adding a gas-forming substance comprising calcium carbonate to the ingot mold;

(b) adding the iron ore pellets to the ingot mold;

(c) adding liquid iron to the ingot mold; and (d) allowing the gas-forming substance to release gases and the liquid iron to solidify, thereby forming a dispersed gas phase within the product.

12. The method of claim 11 where the weight of the gas-forming substance is between 6% and 12% of the total weight of the iron ore pellets and the liquid iron, and the volume of liquid iron added to the ingot mold is between 26% and 60% of the mold volume.

* * * * *